US011056292B2

(12) United States Patent
Shen

(10) Patent No.: US 11,056,292 B2
(45) Date of Patent: Jul. 6, 2021

(54) KEYSWITCH AND KEYBOARD

(71) Applicant: Silitek Electronics (Dongguan) Co., Ltd, Guang Dong (CN)

(72) Inventor: HaiNan Shen, Guang Dong (CN)

(73) Assignee: Silitek Electronics (Dongguan) Co., Ltd., Dong Guan (CN)

( * ) Notice: Subject to any disclaimer, the term of this patent is extended or adjusted under 35 U.S.C. 154(b) by 0 days.

(21) Appl. No.: 16/796,760

(22) Filed: Feb. 20, 2020

(65) Prior Publication Data

US 2021/0005406 A1 Jan. 7, 2021

(30) Foreign Application Priority Data

Jul. 5, 2019 (CN) ..... 201910603937.0

(51) Int. Cl.
*H01H 13/7073* (2006.01)
*H01H 13/86* (2006.01)

(52) U.S. Cl.
CPC ..... *H01H 13/7073* (2013.01); *H01H 13/86* (2013.01); *H01H 2221/058* (2013.01); *H01H 2221/062* (2013.01)

(58) Field of Classification Search
CPC .... H01H 13/14; H01H 3/125; H01H 13/7065; H01H 2221/044; H01H 2221/036; H01H 13/48; H01H 13/52; H01H 13/56; H01H 13/20; H01H 13/36; H01H 13/365; H01H 15/02; H01H 15/06; H01H 1/242; H01H 13/12; H01H 13/28
See application file for complete search history.

(56) References Cited

U.S. PATENT DOCUMENTS 4,453,198 A * 6/1984 Bush ..... H01H 13/705 200/342
4,755,645 A * 7/1988 Naoki ..... H01H 13/20 200/276.1
5,794,762 A * 8/1998 Tsai ..... H01H 13/705 200/345

FOREIGN PATENT DOCUMENTS

CN 204348568 U 5/2015

* cited by examiner

*Primary Examiner* — Ahmed M Saeed
(74) *Attorney, Agent, or Firm* — Umberg Zipser LLP

(57) ABSTRACT

The present invention disclosed a keyswitch comprising a housing, a keycap, a circuit board, an elastic body, a guiding part, and a cushioning part. The housing comprises an opening. The keycap is disposed on the housing. The circuit board is disposed under the housing. The elastic body is disposed on the circuit board and is disposed between the housing and the circuit board. One end of the guiding part is disposed on the elastic body, and the other end corresponds to the opening and is connected with the keycap. The cushioning part is disposed between the guiding part and the housing, wherein the cushioning part cushions the collision between the guiding part and the housing when the keycap moves away from the housing. When the keyswitch is restored, the guiding part does not directly hit the housing. The present invention also disclosed a keyboard using the keyswitch.

10 Claims, 6 Drawing Sheets

KEYSWITCH AND KEYBOARD

This application claims the priority benefit of Chinese Patent Application Serial Number 201910603937.0, filed on Jul. 5, 2019, the full disclosure of which is incorporated herein by reference.

BACKGROUND

Technical Field

The present invention relates to the technical field of keyboard, in particularly to a keyswitch and a keyboard.

Related Art

The existing keyboards are mainly thin film keyboards and mechanical keyboards. There are three types of thin film keyboards: "crater type", "scissor type" and "pillar type", according to the keyswitch support structure. In general, the pressing feeling of the "crater type" and "pillar type" keyboard comes from the co-configuration of the elastic body and the guiding part at the bottom of a keyswitch. When the user presses a keyswitch, the elastic body is compressed by the pressing force to press down the keyswitch. When the keyswitch is released, the restoring force of the elastic body applies to the guiding part, causing the keycap to move to restore to the origin position. Then, the guiding part is blocked by the housing and stops moving. Thus, the keycap restores to the origin position. However, the guiding part stops moving by directly hitting the top of the housing, which causes unpleasant sounds during typing.

SUMMARY

The present invention provides a keyswitch and a keyboard to solve the issue of the hitting sound from that the guiding part inside the keyswitch directly hits the housing when the keyswitch is reset in the prior art.

To solve the problems above, the present invention provides a keyswitch, comprising a housing, a keycap, a circuit board, an elastic body, a guiding part, and a cushioning part. The housing has an opening. The keycap is disposed on the housing. The circuit board is disposed under the housing. The elastic body is disposed on the circuit board and is disposed between the housing and the circuit board. One end of the guiding part is disposed on the elastic body, and the other end is corresponding to the opening and connecting to the keycap. The cushioning part is disposed between the guiding part and the housing. Wherein the cushioning part cushions a collision between the guiding part and the housing when the keycap is away from the housing.

The present invention further provides a keyboard, comprising a baseplate, a circuit board, and a plurality of the keyswitchs. The circuit board is disposed on the baseplate. And a plurality of the keyswitchs are disposed on the circuit board.

According to an embodiment of the present invention, the cushioning part disposed between the guiding part and housing can cushion the kinetic force of the guiding part moving toward the housing applied by the elastic body. This will prevent the guiding part from directly hitting the housing. Thus, to reduce or eliminate the noise by the use of the keyswitch.

It should be understood, however, that this summary may not contain all aspects and embodiments of the present invention, that this summary is not meant to be limiting or restrictive in any manner, and that the invention as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
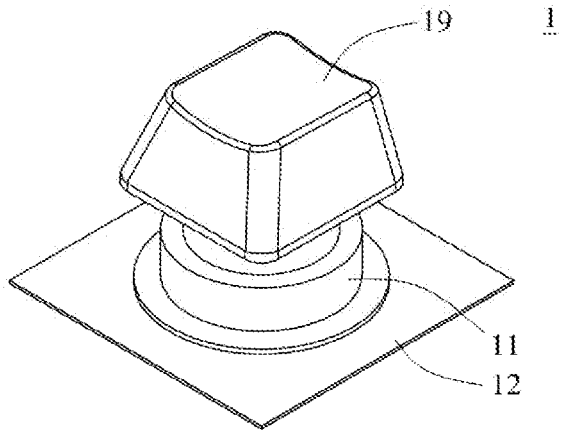
FIG. 1 is a perspective view of the keyswitch of the first embodiment of the present invention.

The present invention will now be described more fully hereinafter with reference to the accompanying drawings, in which exemplary embodiments of the invention are shown. This present invention may, however, be embodied in many different forms and should not be construed as limited to the embodiments set forth herein. Rather, these embodiments are provided so that this present invention will be thorough and complete, and will fully convey the scope of the present invention to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the invention. This description is made for the purpose of illustration of the general principles of the invention and should not be taken in a limiting sense. The scope of the invention is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the invention.

Figure 2:
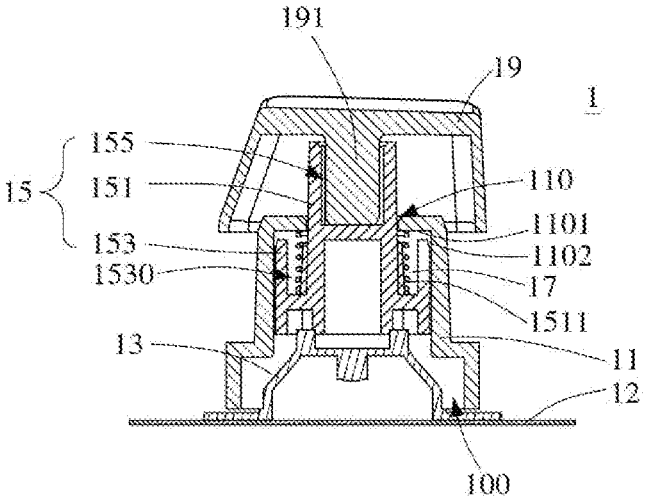
FIG. 2 is a cross-sectional view of the keyswitch of the first embodiment of the present invention.

FIG. 1 and FIG. 2 are the perspective view and the cross-sectional view of the keyswitch of the first embodiment of the present invention. As shown in the figures, the present embodiment provides a keyswitch 1 which reduces or eliminates noise from the collision between the guiding part and the housing by providing a cushioning part between the guiding part and the housing. The keyswitch 1 of the present embodiment comprises a housing 11, a circuit board 12, an elastic body 13, a guiding part 15, a cushioning part 17, and a keycap 19.

Figure 3:
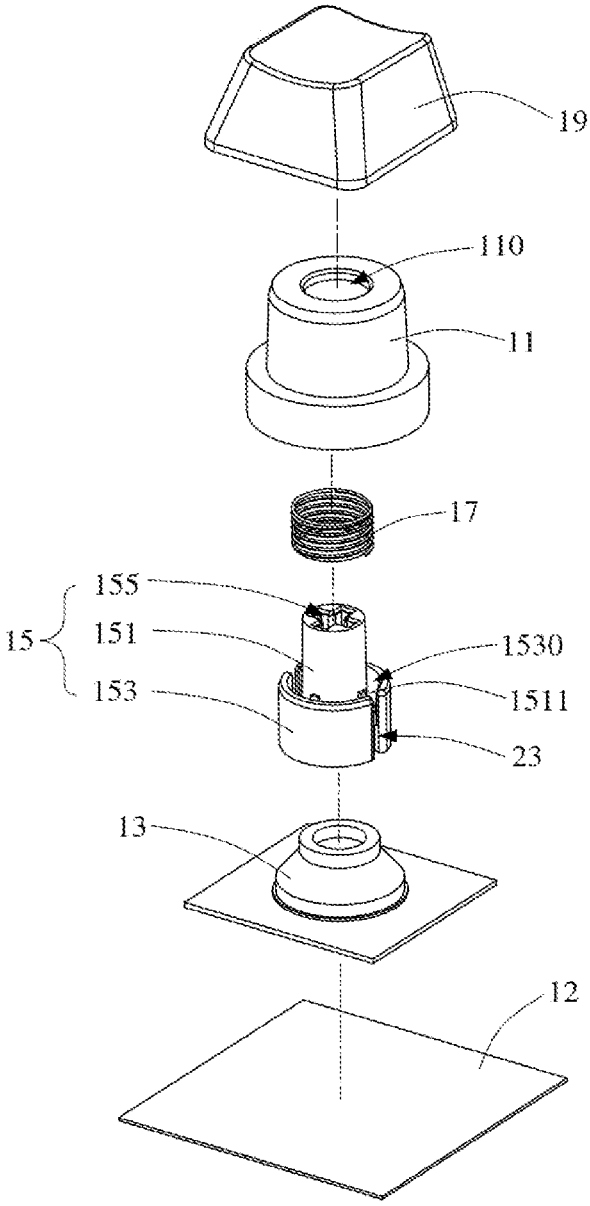
FIG. 3 is an exploded view of the keyswitch of the first embodiment of the present invention.
Figure 4:
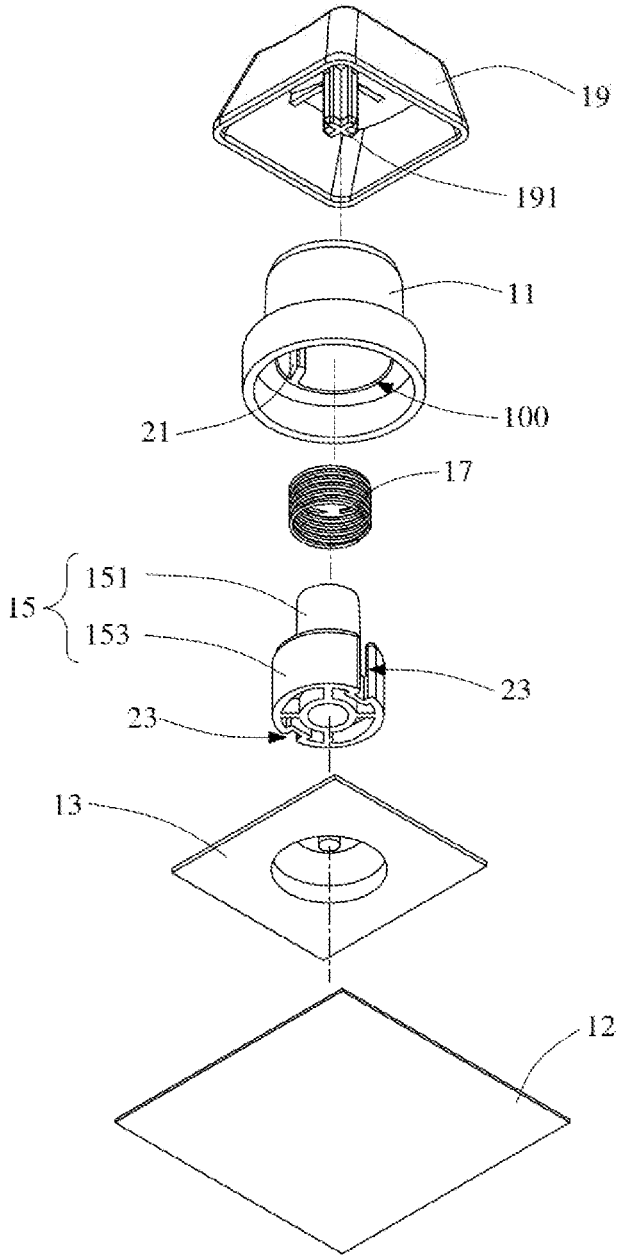
FIG. 4 is another exploded view of the keyswitch of the first embodiment of the present invention.

FIG. 3 and FIG. 4 are the exploded views of the keyswitch of the first embodiment of the present invention. In the present embodiment as shown in the figures, the circuit board 12 comprises a plurality of contacts (not shown). The housing 11 is on the circuit board 12. The housing 11 comprises an accommodation 100 and an opening 110. The opening 110 is located at one end of the housing 11 away from the circuit board 12. The opening 110 is connected to the accommodation 100. In other words, the housing 11 comprises an accommodation 100, a surrounding wall 1102, and an abutting wall 1101. The surrounding wall 1102 surrounds the accommodation 100 and extends in the direction in which the keyswitch is pressed. One end of the surrounding wall 1102 away from the circuit board 12 is provided with an abutting wall 1101. The abutting wall 1101 is formed by the extension of the surrounding wall 1102 toward the pressing direction of the keyswitch. The abutting wall 1101 is provided with an opening 110. The opening 110 is connected to the accommodation 100.

The elastic body 13 is disposed on the circuit board 12 and corresponds to the contacts on the circuit board 12. Wherein the elastic body 13 is located between the housing 11 and the circuit board 12, and a part/entire of the elastic body 13 is in the accommodation 100 of the housing 11 and corresponds to the opening 110 of the housing 11. In the present embodiment, the elastic body 13 is a rubber cap. In other embodiments, the elastic body 13 can also be a spring or a reciprocating switch, and etc.

Furthermore, the guiding part 15 is disposed on the elastic body 13 and corresponds to the opening 110 of the housing 11. The guiding part 15 is in the accommodation 100 of the housing 11, or one end of the guiding part 15 away from the elastic body 13 extrudes from the opening 110 of the housing 11. In the present embodiment, the guiding part 15 comprises a body part 151 and an abutting part 153. The abutting part 153 is disposed on the circumferential side of the body part 151. One end of the body part 151 is disposed above the elastic body 13. The other end of the body part 151 passes through and disposed at the opening 110 of the housing 11. The abutting part 153 corresponds to the abutting wall 1101 of the housing 11. In other words, the abutting wall 1101 of the housing 11 blocks the abutting part 153 resulting in the guiding part 15 cannot be detached from the opening 110, thereby preventing the guiding part 15 from being detached from the housing 11.

Moreover, the cushioning part 17 is disposed between the guiding part 15 and the housing 11. That is, the cushioning part 17 is sleeved on the body part 151 of the guiding part 15, and cushioning part 17 is disposed between the abutting part 153 and the abutting wall 1101 of the housing 11. In the present embodiment, an annular groove 1530 is formed between the body part 151 and the abutting part 153. One end of the cushioning part 17 is disposed in the annular groove 1530, and the other end of the cushioning part 17 protrudes out of the annular groove 1530 and abuts against the abutting wall 1101 of the housing 11 to maintain the gap distance between the abutting part 153 and the abutting wall 1101 of the housing 11 also to prevent the cushioning part 17 from coming off the annular groove 1530. The cushioning part 17 is an elastic component such as a spring or a rubber ring but is not limited thereto.

Furthermore, the guiding part 15 further comprises a plurality of bumps 1511. The plurality of bumps 1511 is disposed at the circumference side of the body part 151 and is disposed in the annular groove 1530. In the present embodiment, the plurality of bumps 1511 is integrally formed with the body part 151 and protrude from the circumferential side of the body part 151. The cushioning part 17 is disposed on the outer side of the plurality of bumps 1511. Thus, the reinforcing of securing the cushioning part 17 in the annular groove 1530 by abutting the protrusion 1511 against the inner surface of the cushioning part 17. In addition, by the plurality of bumps 1511, the cushioning part 17 is spaced apart from the circumferential side of the body part 151, and also possible to make the cushioning part 17 away from the assembly gap between the body 151 of the guiding part 15 and the opening 110 of the housing 11. The cushioning part 17 then can be ensured to abut against the abutting wall 1101 of the housing 11.

The housing 11 comprises a first restricting part 21, and the abutting part 153 of the guiding part 15 has a second restricting part 23. When the guiding part 15 is disposed on the housing 11, the first restricting part 21 in the housing 11 cooperates to the second restricting part 23 of the abutting part 153, restricting the horizontal rotation of the guiding part 15 relative to the housing 11. The first restricting part 21 is a bump, and the second restricting part 23 is a grooved channel. The bump of the first restricting part 21 moves in corresponding to the grooved channel of the second restricting part 23. Thus, the moving direction of the guiding part 15 can be restricted, and the guiding part 15 can only move along the pressing direction of the keyswitch. In other embodiments, the first restricting part 21 can also be a grooved channel, so the second restricting part is a bump. The number of the first restricting part 21 can be one or more than one, and the number of the second restricting part 23 can be one or more than one in corresponding with the number of the first restricting part 21.

The keycap 19 is disposed on the guiding part 15 and also disposed on the housing 11. Wherein the keycap 19 comprises a positioning pin 191, and the guiding part 15 comprises a groove 155. The positioning pin 191 is engaged into the groove 155. In the present embodiment, the positioning pin 191 a cruciform prism, and the groove 155 corresponding to the positioning pin 191 is a cruciform groove. Thus, the keycap 19 will not horizontally rotate relative to the guiding part 15 when the keycap 19 is engaged with the guiding part 15. In other embodiments, the keycap 19 can also comprise a groove, so the guiding part 15 comprises a positioning pin.

Figure 5:
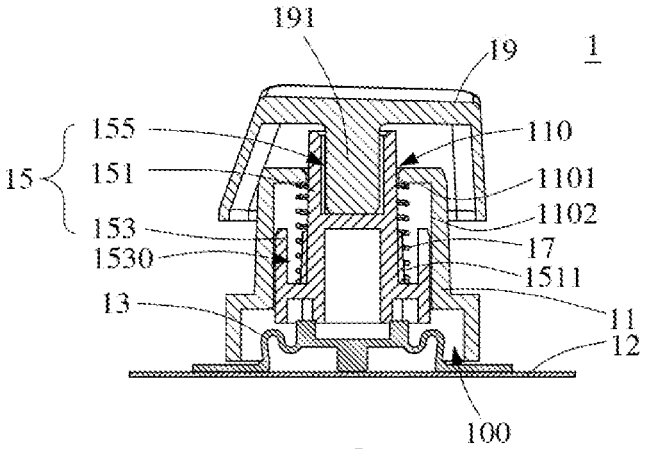
FIG. 5 is another cross-sectional view of the keyswitch of the first embodiment of the present invention.

FIG. 5 is another cross-sectional view of the keyswitch of the first embodiment of the present invention. As shown in FIG. 2 and FIG. 5, in the present embodiment, when the keyswitch 1 is not in use (as shown in FIG. 2), the keycap 19 is supported by the elastic body 13. At this time, the elastic body 13 is in an initial state, that is, an uncompressed state. The cushioning part 17 is compressed by the abutting part 153 of the guiding part 15 and the abutting wall 1101 of the housing 11 and keeps the distance between the abutting part 153 and the abutting wall 1101 of the housing 11 at the same time. At this time, the cushioning part 17 is in a first state, that is, the state in which the amount of compression is large; the elastic body 13 and the cushioning part 17 are in a state of force balance. Wherein the elastic coefficient of the elastic body 13 is greater than the elastic coefficient of the cushioning part 17.

When the user presses the keyswitch 1 (as shown in FIG. 5), the keycap 19 moves downward relative to the housing 11. The keycap 19 presses the guiding part 15, and the guiding part 15 compresses the elastic body 13 to deform the elastic body 13. The deformed elastic body 13 touches the contacts on the circuit board 12 to achieve an electrical connection. At this time, the distance between the abutting part 153 of the guiding part 15 and the abutting wall 1101 of the housing 11 becomes larger, and the restriction of compression of the cushioning part 17 by the abutting part 153 and the abutting wall 1101 is reduced, hence the cushioning part is in a second state. That is, the second state of the cushioning part refers to a state of no-compression or the amount of the compression is small.

When the keyswitch 1 is no longer pressed, the compressed elastic body 13 is released to generate an upward restoring force and push the abutting part 153 of the guiding part 15 toward the abutting wall 1101 of the housing 11. Before the abutting part 153 contacts with the abutting wall 1101 of the housing 11, the cushioning part 17 first contacts the abutting wall 1101 of the housing 11. Then, the abutting part 153 continues to move toward the inner wall around the opening 110 of the housing 11 and further compresses the cushioning part 17. The compressed cushioning part 17 generates a force that resists the movement of the abutting part 153 toward the abutting wall 1101 of the casing 11. In the process of keyswitch restoring, the cushioning part 17 will be continuously compressed. Thus, the cushioning part 17 can prevent the abutting part 153 of the guiding part 15 from directly hitting the abutting wall 1101 of the housing 11, thereby to eliminate noise caused by direct collision. After the elastic body 13 and the cushioning part 17 are in a state of force balance, the guiding part 15 returns to the position where the keyswitch 1 is not in use.

In another embodiment, the cushioning part 17 is in a first state where the keyswitch 1 is not in use. That is the state with large amount of compression. The cushioning part 17 is disposed in the annular groove 1530. At the same time, the other end of the cushioning part 17 abuts against the abutting wall 1101 of the housing 11, and the abutting part 153 of the guiding part 15 is in contact with the abutting wall 1101 of the housing 11.

When the keyswitch 1 is no longer pressed, the compressed elastic body 13 is released to generate an upward restoring force reducing the distance between the abutting part 153 of the guiding part 15 and the abutting wall 1101 of the housing 11, and the cushioning part 17 is then compressed. The cushioning part 17 generates a force that resists the movement of the abutting part 153 of the guiding part 15 toward the abutting wall 1101 of the casing 11. The abutting part 153 and the housing 11 still contact to sound, but the force that moves the abutting part 153 toward the abutting wall 1101 of the housing 11 can be cushioned by the cushioning part 17 to reduce the contacting noise.

In one separate embodiment from the foregoing, in the case where the keyswitch 1 is not in use, the first state of the cushioning part 17 may also refer to an uncompressed state. That is, both ends of the cushioning part 17 abut against the abutting part 153 of the guiding part 15 and the abutting wall 1101 of the housing 11 respectively while maintaining the distance between the abutting part 153 and the abutting wall 1101 of the housing 11.

When the keyswitch 1 is pressed and then restored, the elastic body 13 returns to the initial state and jacks up the guiding part 15. The abutting part 153 moves toward the abutting wall 1101 of the casing 11. When the distance between the abutting part 153 and the abutting wall 1101 is smaller than the distance described above, the cushioning part 17 starts to be compressed, generating a force against the movement of the abutting part 153 to the abutting wall 1101. The abutting part 153 is prevented from directly hitting the abutting wall 1101, thereby reducing or eliminating noise generated by direct collision.

Figure 6:
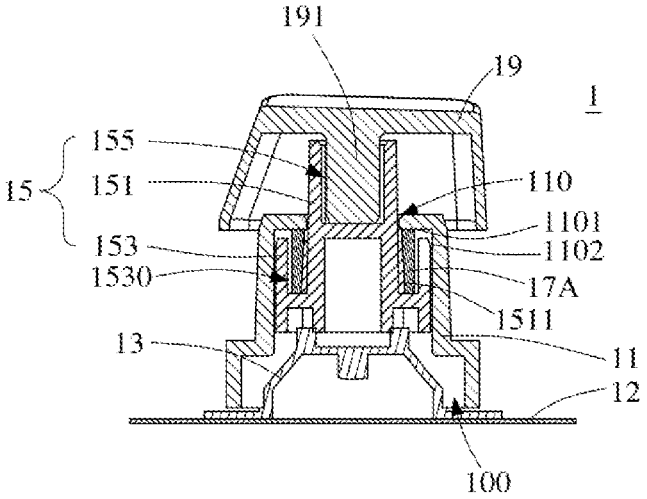
FIG. 6 is a cross-sectional view of the keyswitch of the second embodiment of the present invention.

FIG. 6 is a cross-sectional view of the keyswitch of the second embodiment of the present invention. As shown in the figure, the difference between the present embodiment and the first embodiment is that the cushioning part 17A is a rubber ring or other elastic material having the same function and purpose as those of the first embodiment. Hence, it will not be described here again.

Figure 7:
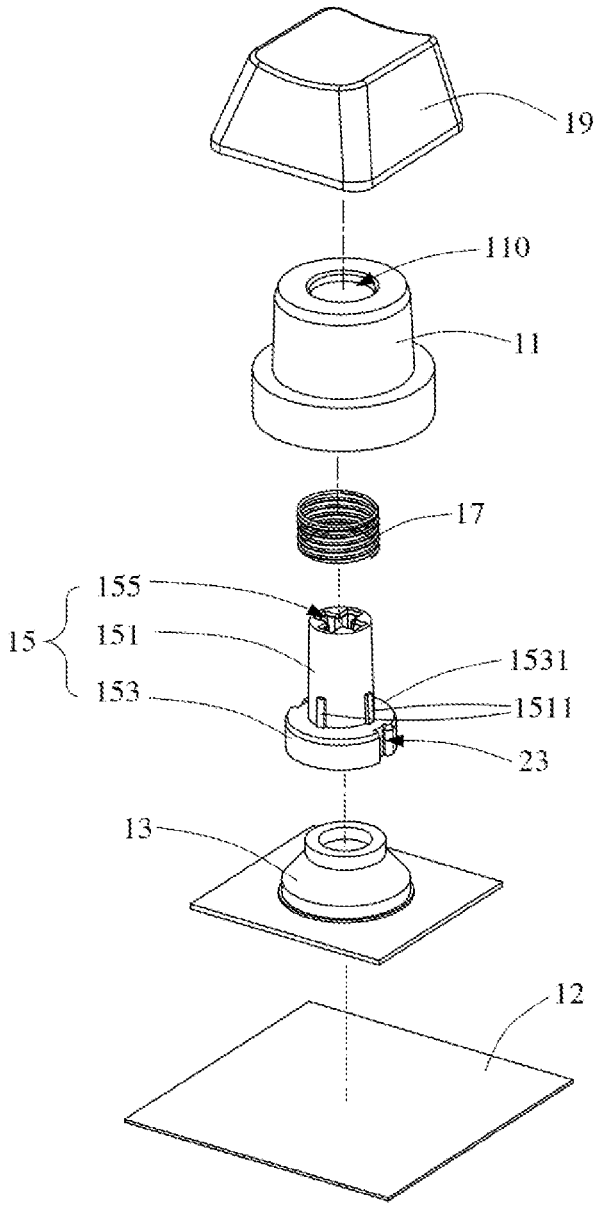
FIG. 7 is an exploded view of the keyswitch of the third embodiment of the present invention.
Figure 8:
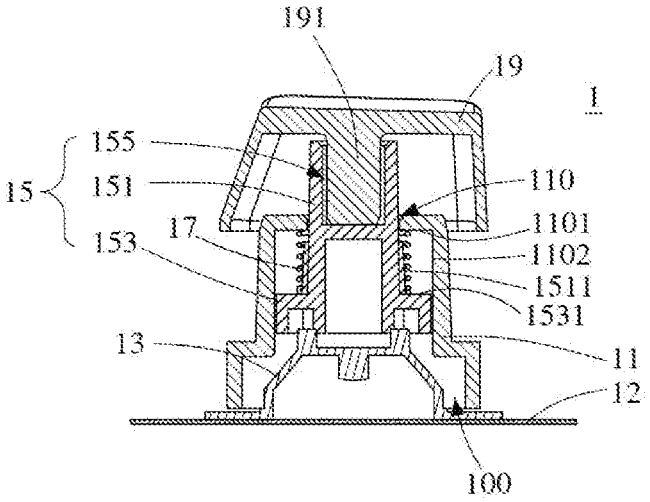
FIG. 8 is a cross-sectional view of the keyswitch of the third embodiment of the present invention.

FIG. 7 and FIG. 8 are a exploded view and a cross-sectional view of the keyswitch of the third embodiment of the present invention. As shown in the figures, the difference between this embodiment and the first embodiment is the guiding part 15. The guiding part 15 of the present embodiment does not comprise an annular groove. The guiding part 15 of the present embodiment comprises a body part 151 and an abutting part 153, and the abutting part 153 is disposed on the circumferential side of the body part 151. One end of the abutting part 153 away from the circuit board comprises a platform 1531, wherein the platform 1531 is annularly disposed on the body part 151. The cushioning part 17 is sleeved on the body part 151. One end of the cushioning part 17 is disposed on the platform 1531, and the other end is in contact with the abutting wall 1101 around the opening 110 of the housing 11. Furthermore, the guiding part 15 can also comprise a plurality of bumps 1511 disposed on the circumferential side of the body part 151. The cushioning part 17 is annularly disposed on the outer side of the plurality of bumps 1511. The present embodiment is structurally simpler than the first embodiment.

In addition, in the present embodiment, the keyswitch 1 can also be applied to a keyboard of an electronic device, wherein the electronic device can be a computer, a laptop, or any electronically-related device that can use a keyboard. Particularly, the keyboard comprises a baseplate, a circuit board, and a plurality of the keyswitchs 1. Wherein the circuit board is disposed on the baseplate, and a plurality of the keyswitchs 1 are disposed on the circuit board.

In summary, the present invention proposed a keyswitch and keyboard, wherein the restoring force of the elastic body is cushioned by the cushioning part inside the keyswitch when the keyswitch is restoring. Therefore, the noise generated by the direct collision of the guiding part on the housing can be reduced or eliminated.

It is to be understood that the term "comprises", "comprising", or any other variants thereof, is intended to encompass a non-exclusive inclusion, such that a process, method, article, or device of a series of elements not only include those elements but also includes other elements that are not explicitly listed, or elements that are inherent to such a process, method, article, or device. An element defined by the phrase "comprising a . . . " does not exclude the presence of the same element in the process, method, article, or device that comprises the element.

Although the present invention has been explained in relation to its preferred embodiment, it does not intend to limit the present invention. It will be apparent to those skilled in the art having regard to this present invention that other modifications of the exemplary embodiments beyond those embodiments specifically described here may be made without departing from the spirit of the invention. Accordingly, such modifications are considered within the scope of the invention as limited solely by the appended claims.

What is claimed is:

1. A keyswitch, comprising:

a housing having an opening;

a keycap disposed on the housing;

a circuit board disposed under the housing;

an elastic body disposed on the circuit board and disposed between the housing and the circuit board;

a guiding part, one end of which disposed on the elastic body, and the other end corresponding to the opening and connecting to the keycap; and a cushioning part disposed between the guiding part and the housing;

wherein the cushioning part cushions a collision between the guiding part and the housing when the keycap moves away from the housing;

wherein the housing comprises:

an abutting wall;

the opening is formed on the abutting wall;

the cushioning part is disposed between the guiding part and the housing, and contacts the abutting wall;

wherein the guiding part comprises:

a body part and an abutting part;

the abutting part is disposed on a circumference side of the body part;

the cushioning part is sleeved onto the body part;

both ends of the cushioning part respectively contact the abutting part and the abutting wall.

2. The keyswitch according to claim 1, wherein the guiding part further comprises:

a plurality of bumps;

the plurality of the bumps is disposed at the circumference side of the body part;

the cushioning part is sleeved onto the outer side of the plurality of the bumps.

3. The keyswitch according to claim 1, wherein an annular groove is formed between the body part and the abutting part; the cushioning part is disposed in the annular groove.

4. The keyswitch according to claim 1, wherein the cushioning part is a spring or a rubber ring.

5. The keyswitch according to claim 1, wherein the elastic coefficient of the elastic body is greater than the elastic coefficient of the cushioning part.

6. The keyswitch according to claim 1, wherein the keycap and the guiding part are engaged by a positioning pin and a groove.

7. The keyswitch according to claim 1, wherein the housing comprises a first restricting part; the guiding part comprises a second restricting part; the first restricting part is engaged to the second restricting part.

8. The keyswitch according to claim 7, wherein the first restricting part is a bump; the second restricting part is a grooved channel.

9. The keyswitch according to claim 7, wherein the first restricting part is a grooved channel; the second restricting part is a bump.

10. A keyboard, comprising:

a baseplate;

a circuit board disposed on the baseplate;

a plurality of keyswitchs disposed on the circuit board;

wherein each of the keyswitchs comprises a housing having an opening;

a keycap disposed on the housing;

an elastic body disposed on the circuit board and disposed between the housing and the circuit board;

a guiding part, one end of which disposed on the elastic body, and the other end corresponding to the opening and connecting to the keycap; and a cushioning part disposed between the guiding part and the housing;

wherein the cushioning part cushions a collision between the guiding part and the housing when the keycap moves away from the housing;

wherein the housing comprises:

an abutting wall;

the opening is formed on the abutting wall;

the cushioning part is disposed between the guiding part and the housing, and contacts the abutting wall;

wherein the guiding part comprises:

a body part and an abutting part;

the abutting part is disposed on a circumference side of the body part;

the cushioning part is sleeved onto the body part;

both ends of the cushioning part respectively contact the abutting part and the abutting wall.

* * * * *